US009089758B2

(12) United States Patent
McWilliams, PGA

(10) Patent No.: US 9,089,758 B2
(45) Date of Patent: Jul. 28, 2015

(54) APPARATUS, METHOD AND SYSTEM FOR AN INDOOR PUTTING GREEN

(71) Applicant: Matthew D. McWilliams, PGA, Ocean Pines, MD (US)

(72) Inventor: Matthew D. McWilliams, PGA, Ocean Pines, MD (US)

( * ) Notice: Subject to any disclaimer, the term of this patent is extended or adjusted under 35 U.S.C. 154(b) by 138 days.

(21) Appl. No.: 13/952,217

(22) Filed: Jul. 26, 2013

(65) Prior Publication Data

US 2015/0031465 A1 Jan. 29, 2015

(51) Int. Cl.
*A63B 69/36* (2006.01)

(52) U.S. Cl.
CPC ..... *A63B 69/3661* (2013.01); *A63B 69/3676* (2013.01)

(58) Field of Classification Search
USPC ..... 473/157–163, 167, 180, 181, 182–185
See application file for complete search history.

(56) References Cited

U.S. PATENT DOCUMENTS

| | | | | | |
|---|---|---|---|---|---|
| 1,818,749 | A * | 8/1931 | Pittler | ..... | 473/158 |
| 2,539,046 | A * | 1/1951 | Wright | ..... | 473/159 |
| 3,671,042 | A * | 6/1972 | Garber | ..... | 473/165 |
| 3,762,718 | A * | 10/1973 | Culley | ..... | 473/160 |
| 3,858,887 | A * | 1/1975 | Wallin | ..... | 473/157 |
| 3,862,760 | A * | 1/1975 | Davis | ..... | 473/159 |
| 3,897,067 | A * | 7/1975 | Smith | ..... | 473/160 |
| 4,192,511 | A * | 3/1980 | Fitzgerald | ..... | 473/162 |
| 4,344,624 | A * | 8/1982 | Laursen | ..... | 473/159 |
| 4,805,912 | A * | 2/1989 | Hickman | ..... | 473/159 |
| 4,828,267 | A * | 5/1989 | Goodrich | ..... | 473/160 |
| 4,850,594 | A * | 7/1989 | Manzione | ..... | 473/162 |
| 4,949,970 | A * | 8/1990 | Culley | ..... | 473/160 |
| 5,586,941 | A * | 12/1996 | Klearman | ..... | 473/160 |
| 5,725,438 | A * | 3/1998 | Dennesen | ..... | 473/163 |
| 5,749,789 | A * | 5/1998 | Karl | ..... | 473/162 |
| 6,623,370 | B1 * | 9/2003 | Willer | ..... | 473/169 |
| 6,769,995 | B1 * | 8/2004 | Rhodes et al. | ..... | 473/265 |
| 7,140,971 | B2 * | 11/2006 | Trudeau | ..... | 473/180 |
| 2008/0102968 | A1 * | 5/2008 | Andersen | ..... | 473/157 |
| 2009/0023509 | A1 * | 1/2009 | Park | ..... | 473/156 |
| 2009/0124404 | A1 * | 5/2009 | Taira et al. | ..... | 473/157 |
| 2012/0295722 | A1 * | 11/2012 | Vancho et al. | ..... | 473/157 |

* cited by examiner

*Primary Examiner* — Mark Graham
(74) *Attorney, Agent, or Firm* — Maier & Maier, PLLC

(57) ABSTRACT

A putting practice system and apparatus including a main unit, putting pad and rail. The main unit has a bored hole through a top surface into a hollow portion of the main unit. The putting pad has a front end and a rear end and is located at a distance to the main unit. At least one rail is between the main unit and putting pad, the rail having a center portion, a left side, and a right side extending the entire length of the rail between.

13 Claims, 5 Drawing Sheets

APPARATUS, METHOD AND SYSTEM FOR AN INDOOR PUTTING GREEN

BACKGROUND

Golf is one of the most popular sports in the world. One of the most important aspects of golf is accurate putting, which can significantly improve a golfer's score and handicap. A number of factors have to be assessed and taken into consideration before attempting a putt. These include course conditions such as the speed, the degree, and shape of any slopes between the hole and the ball, and the distance and bearing of the hole from the ball. Furthermore, many individual players have poor fundamental putting mechanics. Poor mechanics may alter the travel path and face angle of the putter head relative to an intended path, which may negatively affect the impact between the putter head and the golf ball resulting in poorly hit putts. Therefore, accurate putting requires a considerable amount of practice.

While putting may be practiced at training facilities proximate a golf course, for convenience many golfers also utilize practice tools at home. For example, indoor putting greens may permit an amateur golfer to practice putting on the floor of their home while watching golf on television, or if weather conditions prevent the use of an outdoor facility. While indoor putting surfaces may be convenient, many limit a golfer to practicing a single type of putt such a as a flat or straight putt. However, very few home training aids are also designed to accurately simulate a variety of sloping or breaking putts from a number of different angles.

BRIEF DESCRIPTION OF THE INVENTION

In one exemplary embodiment, a putting practice system and apparatus may be shown including a main unit, putting pad and rail. The main unit has a bored hole through a top surface into a hollow portion of the main unit. The putting pad has a front end and a rear end and is located at a distance to the main unit. At least one rail is between the main unit and putting pad, the rail having a center portion, a left side, and a right side extending the entire length of the rail between.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
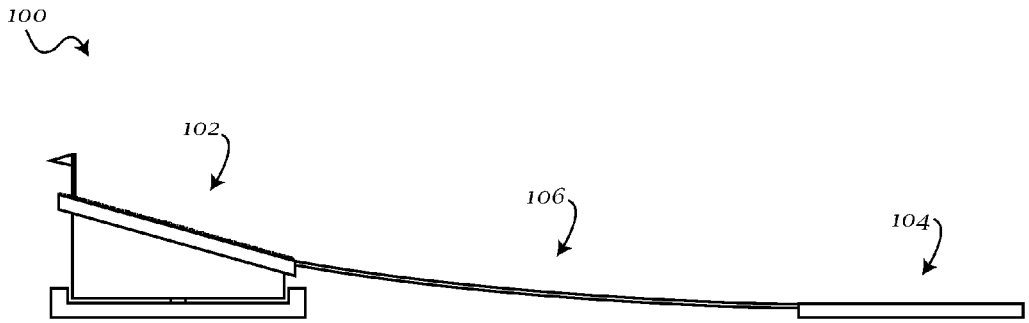
FIG. 1 may show an exemplary embodiment of a practice putting green system and apparatus.

FIG. 1 may show a side and top view of an exemplary embodiment of a putting device 100. Putting device 100 may include a main unit 102, a putting pad 104, and at least one rail 106. Main unit 102 may be located at a distance from putting pad 104, and rail 106 may connect the main unit 102 to the putting pad 104. In an alternative embodiment, a plurality of rails 106 may connect the main unit 102 to the putting pad 104 or to any number of putting pads.

Figure 2:
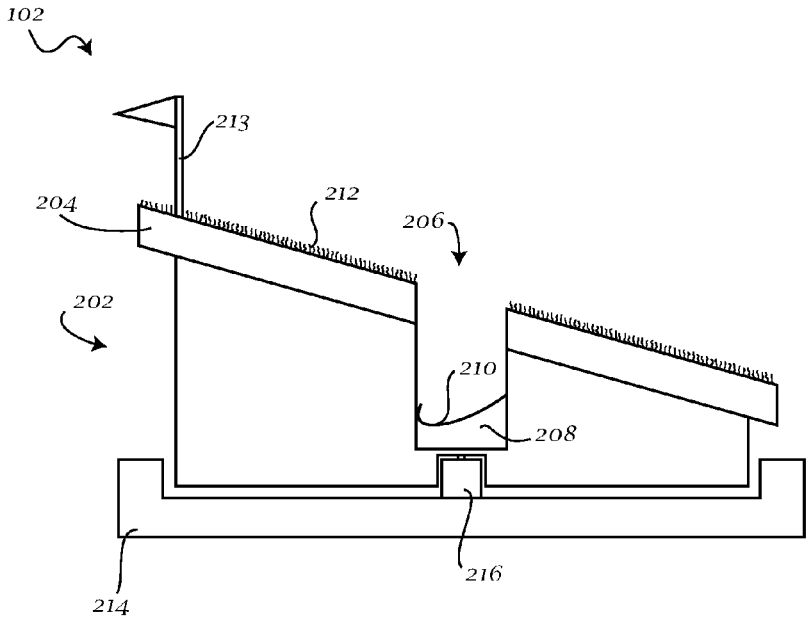
FIG. 2 may show an exemplary embodiment a main unit of a practice putting green system and apparatus.

FIG. 2 may show an exemplary side view of main unit 102 of putting device 100. Main unit 102 may include a putting green 202. Putting green 202 may be raised on a rear side and slope down toward a front side which may, for example, simulate an uphill sloping putting green. In an alternative embodiment, putting green 202 may be raised on a front side and slop down toward a rear side to simulate a downhill putting green. In still further embodiments, putting green 202 may be oriented in any number of ways, for example, to simulate a variety of sloping putting greens. Putting green 202 may be coupled to the at least one rail 106, for example, at a edge or circumference of putting green 202.

Putting green 202 may be, for example, a shell with a substantially circular top 204. In one exemplary embodiment, circular top 204 may be approximately two feet in diameter. In alternative embodiments, circular top 204 may be any of a variety of sizes and shapes as would be understood by a person of ordinary skill in the art.

A hole 206 may be bored through top 204 and putting green 202. Hole 206 may be, for example, the size and shape of a standard golf hole, and may be centered on circular top 204. A hole unit 208 may be received within hole 206. Hole unit 208 may have an automatic ball return 210 which may eject a ball received within hole unit 208.

A green pad 212 may be removably coupled atop the circular top 204. Green pad 212 may be substantially the same size and substantially the same shape of circular top 204. Green pad 212 may include a similarly sized hole as hole 206 such that a golf ball may pass through green pad 212 and circular top 204 and be received within hole unit 208. In some exemplary embodiments, green pad 212 may be customized, for example, with a logo, name, or the like for personalization of the putting device 100.

A flag 213 may be coupled to a raised side of putting green 202. In an exemplary embodiment, flag 213 may be a set screw flag that extends through green pad 212 and may screw into putting green 202. Flag 213 may hold green pad 212 on putting green 202 and may provide visual clues for a user of the putting device 100.

Putting green 202 may be coupled to base 214. Base 214 may further include a spin unit 216 such that putting green 202 may swivel, rotate, or spin about a vertical axis while base 214 may remain in place. In an exemplary embodiment, the putting green 202 may rotate about a vertical axis extending from the center of base 214, hole unit 208, or any other reference point on main unit 102. Hole unit 208 may be coupled to base 214, for example, by a bolt, screw, or the like. In some exemplary embodiments, hole unit 208 may have a sleeve fit over the spin unit 216 such that putting green 202 may rotate 360 degrees about a vertical axis of the center of the hole unit 208.

Figure 3A:
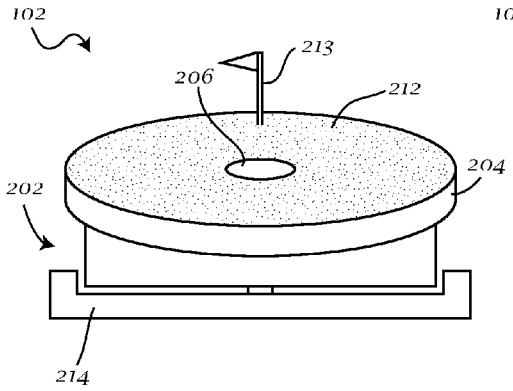
FIGS. 3*a-b* may show an exemplary embodiment of a main unit of a practice putting green system and apparatus.
Figure 3B:
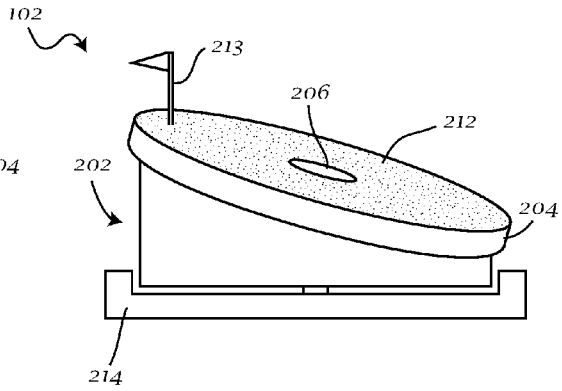

FIGS. 3*a-b* may show prospective front views of main unit 102, for example, as viewed from the putting pad 104. For example, in FIG. 3*a*, main unit 102 may be positioned such that hole 206 and flag 213 are in substantial alignment with respect to putting pad 104 and at least one rail 106. FIG. 3*b* may show a view of main unit 102 that has been rotated from the position shown in FIG. 3*a*, for example, in a counter clockwise direction. For example, base 214 may remain in place, while putting green 202, green pad 212, hole 206, and flag 213 may be rotated counter clockwise. As such, hole 206 and flag 213 may no longer be in substantial alignment with respect to putting pad 104 and at least one rail 106.

As explained in more detail below, FIG. 3*a* may show a straight putt, while FIG. 3*b* may show a breaking put, from the perspective of putting pad 104. It should be understood by a person of ordinary skill that "break" may be defined, for example, as the amount the path of a putted ball curves or deviates from a straight line. In alternative exemplary embodiments, main unit 102 may rotate 360 degrees in the clockwise direction, the counterclockwise direction, or both. As a result, a user of the putting device 100 may practice any of straight putts, left breaking putts, and right breaking putts, or the like, over any number of angles or degrees of break by, for example, rotating main unit 102.

Figure 4A:
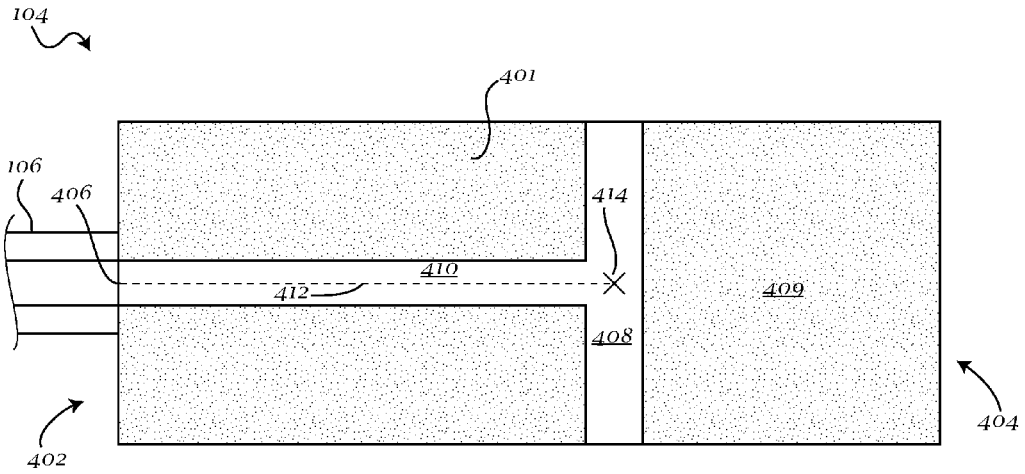
FIGS. 4*a-b* may show an exemplary embodiment of a putting pad.
Figure 4B:
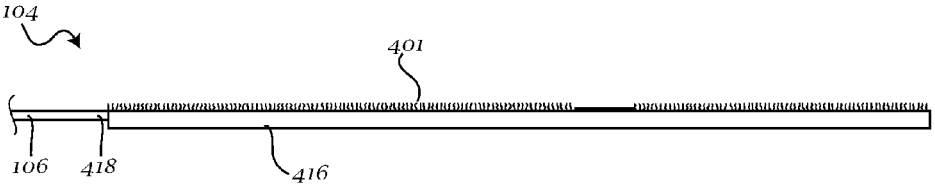

Turning now to FIGS. 4*a-b*, an exemplary embodiment of the putting pad 104 may be shown. Putting pad 104 may be located at a distance to main unit 102. Putting pad 104 and main unit 102 may be coupled by at least one rail 106.

FIG. 4*a* may show an exemplary embodiment of a top surface 401 of putting pad 104. Top surface 401 may be substantially flat and rectangular with a front end 402 and rear end 404. In alternative embodiments, top surface 401 may be square, circular, or any like shape. In still alternative embodiments, putting pad 104 and thus top surface 401 may also have a slope or incline in at least one direction, for example from front end 402 to rear end 404. Front end 402 may be coupled to the at least one rail 106. At least one rail 106 may begin substantially underneath putting pad 104, proximate front end 402. At least one rail may have a surface that may be substantially flush and centered with top surface 401, for example, at a midpoint 406 of front end 402.

Top surface 401 of putting pad 104 may be provided with a number of visual indicators that may train a golfer to hit a straight putt. For example, top surface 401 may have a ball placement area 408. Ball placement area 408 may be between front end 402 and rear end 404 and be substantially parallel thereto. Top surface 401 may also have a stroke area 409 that may be substantially between ball placement area 408 and rear end 404.

In some exemplary embodiments, top surface 401 may also have putting line 410. Putting line 410 may have a length substantially between ball placement area 408 and front end 402. Putting line 410 may have a centerline 412 which may be substantially perpendicular to ball placement area 408 and front end 402. Centerline 412 may intersect front end 402 at midpoint 406, and may intersect ball placement area 408 at a ball placement spot 414.

Ball placement area 408 and putting line 410 may be a different color than other portions of top surface 401. For example, in one exemplary embodiment, ball placement area 408 may be blue, putting line 410 may be white, and the remaining area of top surface 401, including stroke area 409 may be green. It should be understood that the colors noted herein are merely exemplary. In other words, the colors of any portion of top surface 401 may be altered or customized without departing from the scope of the present invention.

FIG. 4*b* may show a side view of putting pad 104, including top surface 401. Putting pad 104 may be removably coupled to an undercarriage 416. Undercarriage 416 may be coupled to at least one rail 106. In an exemplary embodiment, undercarriage 416 may have a beginning rail system 418 that may be formed in one piece with the at least one rail 106. Beginning rail system 418 may be universal to all straight and breaking rails such that the beginning rail position may be the same even on uneven surfaces, or with different rails attached. In another exemplary embodiment, undercarriage 416 may be removably coupled directly to one of a plurality of different rails.

Turning now to FIGS. 5*a-g*, exemplary top views of a putting device 500 with various embodiments of putting rails may be shown. As explained in more detail below, putting rails may have various curvatures, cross sections, banking angles or the like that may simulate the "line" of a putt, which may be defined as the acceptable space a golf ball may occupy and still go in the hole.

As shown in other exemplary embodiments, FIGS. 5*a-g* may show a putting device 500 which may include a main unit 502 and a putting pad 504. For explanatory purposes various points along a circumference on main unit 502 may be described with reference to a standard clock. Thus, as would be understood by a person of ordinary skill, from the perspective of a person standing on putting pad 504, a point at the very bottom of main unit 502 may be, for example, at approximately 6:00. Similarly, a point on the top most side would be approximately 12:00; a point on the right most side would be approximately 3:00, a point on the left most side would be approximately 9:00, and so forth.

Figure 5A:
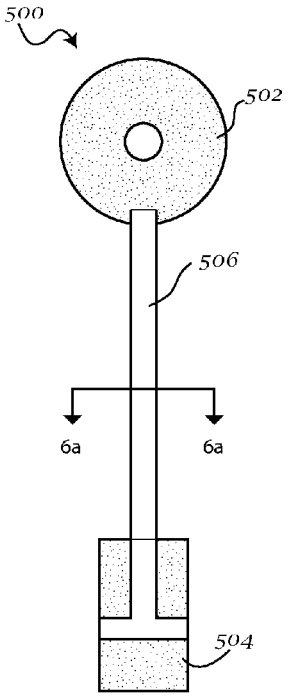
FIGS. 5*a-g* may show exemplary embodiments of a practice putting green system and apparatus.

In FIG. 5*a*, putting device 500 may have at least one rail 506 that is substantially straight. As shown, at least one rail 506 may extend from putting pad 504 in a substantially straight line to a bottom portion of main unit 502. Thus, FIG. 5*a* may show, with reference to the clock analogy, the at least one rail coupled to the main unit at approximately 6:00 with the flag above the hole at approximately 12:00.

Figure 5B:
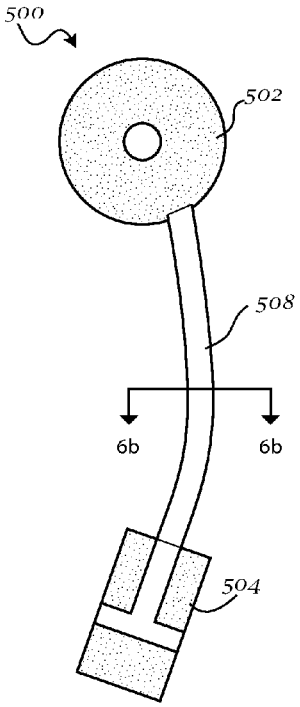

In FIG. 5*b*, putting device 500 may have at least one rail 508. At least one rail 508 may be an exemplary breaking rail. As shown, at least one rail 508 may be curved between putting pad 504 to main unit 502, which may simulate a putt breaking from right to left. Thus, with reference to the clock analogy, at least one rail 508 may enter the main unit to the right of the hole at approximately 4:30.

Figure 5C:
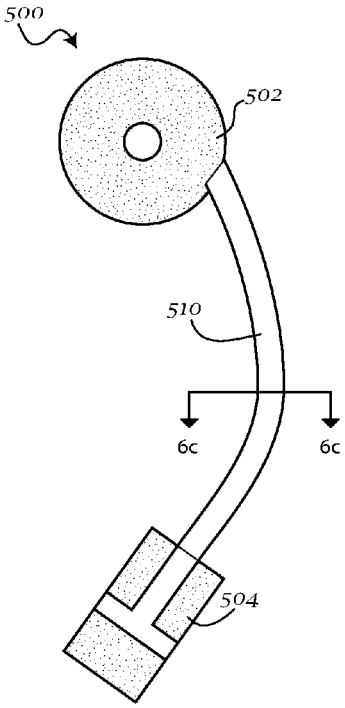

The amount or degree of curvature may be more or less for other exemplary breaking rails, which may simulate putts with more or less break, respectively. For example, as shown in FIG. 5*c*, another exemplary embodiment of a putting device 500 with at least one rail 510 may be shown. Similar to at least one rail 508 shown in FIG. 5*b*, at least one rail 510 may be a breaking rail, which may simulate a putt breaking from right to left. At least one rail 510 may have a greater degree of curvature than at least one rail 508. Thus, with reference to the clock analogy, at least one rail 510 may enter the main unit 502 to the right of the hole at a higher point, for example, at approximately 3:00.

Figure 5D:
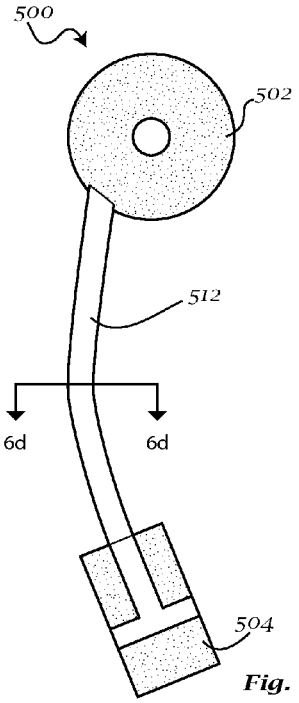

Furthermore, other exemplary embodiments of breaking rails may simulate a putt breaking from left to right. For example, as shown in FIG. 5*d*, a putting device 500 may have at least one rail 512 that may be a breaking rail. As shown, at least one rail 512 may be curved between putting pad 504 to main unit 502, which may simulate a putt breaking from left to right. Thus, with reference to the clock analogy, at least one rail 512 may enter the main unit to the right of the hole at approximately 7:30.

Figure 5E:
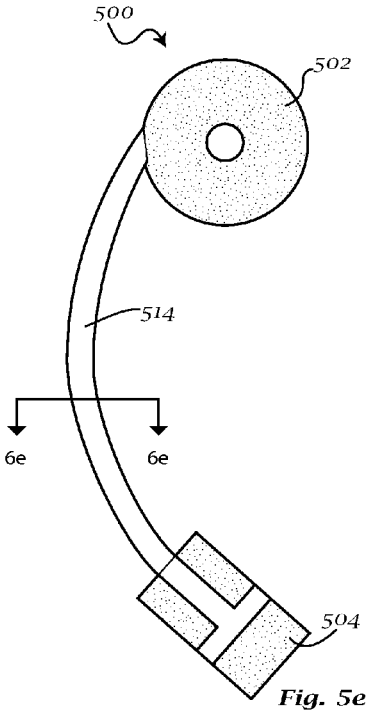

In still another exemplary embodiment as shown in FIG. 5*e*, device 500 with at least one rail 514 may be shown. Similar to at least one rail 512 shown in FIG. 5*d*, at least one rail 514 may be a breaking rail, which may simulate a putt breaking from left to right. At least one rail 514 may have a greater degree of curvature than at least one rail 512. Thus, with reference to the clock analogy, at least one rail 514 may enter the main unit 502 to the right of the hole at a higher point, for example, at approximately 9:00.

As would be understood by a person of ordinary skill in the art, any number of breaking rails, with varying degrees of right to left, or left to right curvature may be designed to couple along any point on the circumference of the main unit without deviating from the scope of the present invention.

Figure 5F:
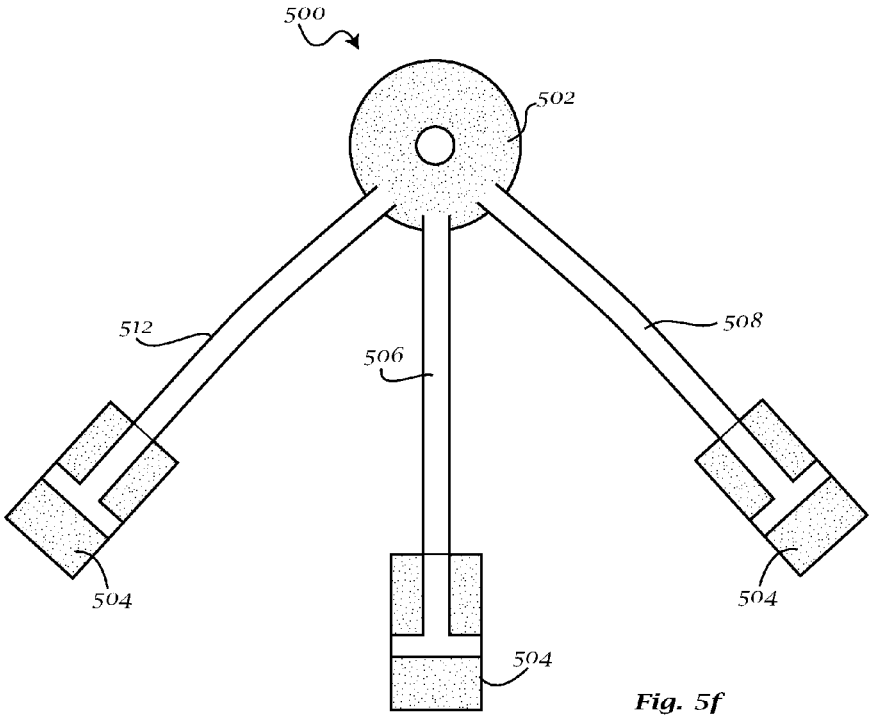
Figure 5G:
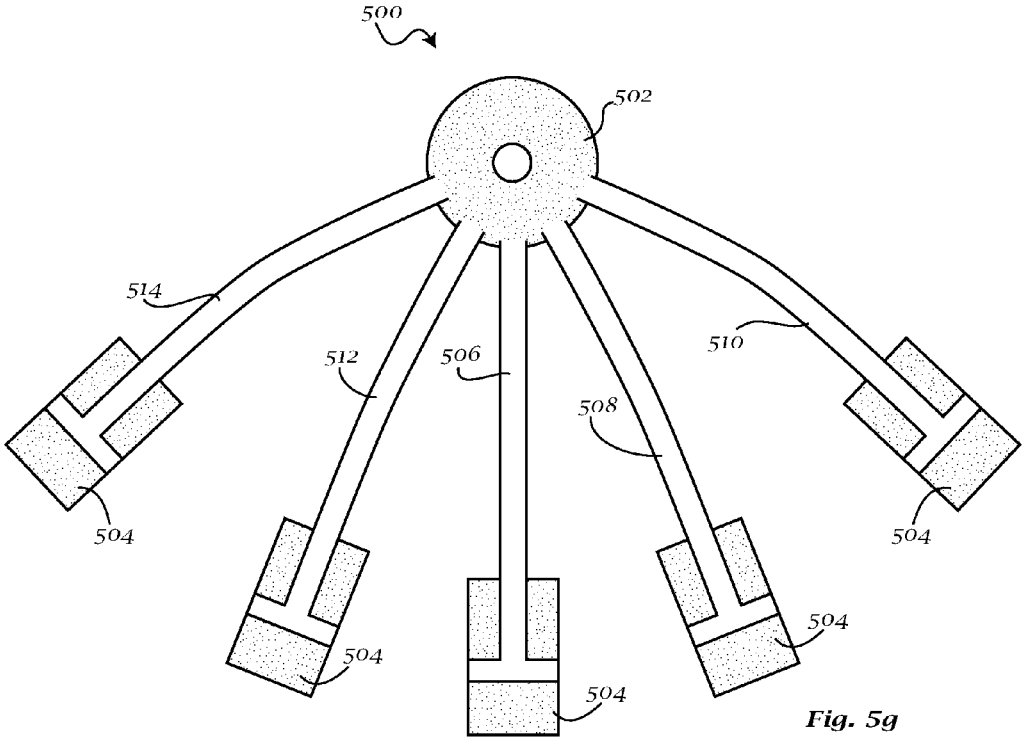

In still another exemplary embodiment as shown in FIGS. 5*f-g*, device 500 may have a plurality of rails simultaneously coupled to main unit 502. For example, in FIG. 5*f*, device 500 may include rails 506, 508, and 512, as previously described, but simultaneously coupled to their respective positions around main unit 502. Similarly, as shown in FIG. 5*g*, device 500 may include rails 506, 508, 510, 512 and 514, as previously described, but simultaneously coupled to their respective positions around main unit 502.

Referring generally to FIGS. 5*f-g*, each of the plurality of rails may have a unique putting pad 504 associated therewith, such that a user may walk around main unit 502 from one putting pad 504 to another to practice different putts at substantially the same time.

Thus, in the exemplary embodiments shown in FIGS. 5*f-g*, the user may practice a variety of different putts without having to detach a first rail and replace with a second rail. As would be understood by a person of ordinary skill in the art, any number of rails may be attached simultaneously to main unit 502, in any variety of combinations and configurations without deviating from the scope of the present invention.

Turning now to FIGS. 6*a*-6*e*, exemplary cross sectional views of respective at least one rails from FIGS. 5*a-e* may be shown. As explained in more detail below, the shape of the at least one rails may simulate the "line" of a putt. Each rail may have a left side, a center portion, and a right side. The side portions of each rail may be raised to represent the amount of offline force that may be required for a ball to leave either side of an acceptable space simulating the line of the putt and not go in the hole.

Breaking rails may have an angled bank, such that one of the left side and the right side may be higher than the other. In some exemplary embodiments, the angled bank may match or simulate the slope of a putting green. Thus, the angle may be adjusted or modified to simulate any slope.

Figure 6A:
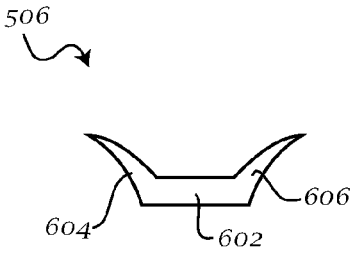
FIGS. 6*a-e* may show exemplary embodiments of a putting rail.

FIG. 6*a* may show an exemplary cross section of at least one rail 506 from FIG. 5*a*. At least one rail 506 may have a center portion 602, a left side 604 and a right side 606. As shown in FIG. 5*a*, at least one rail 506 may be a straight rail with a center portion 602 that may be substantially flat. Left side 604 and right side 606 may be substantially the same height. In this manner, at least one rail 506 may simulate a flat putt.

For example, during use of the exemplary embodiment shown in FIGS. 5*a* and 6*a*, if a golf ball is struck with forward momentum from putting pad 504 and enters rail 506 with any offline force in the left direction, the golf ball may travel up left side 604. Similarly, if the offline force is in the right direction, the golf ball may travel up right side 606. If the offline force is too great in either direction, the golf ball may breach the edge of respective side, and may fall over of the rail, indicating a failed putt. However, if the golf ball is struck with enough forward momentum and within an acceptable range of offline tolerance simulated by the sides of the rail, the golf ball may travel the length of at least one rail 506, and may enter the main unit 502. Thus, with reference to the clock analogy and FIG. 5*a*, the golf ball may exit the at least one rail 506 and may enter the main unit below the hole at approximately 6:00 on the circumference of main unit 102. The golf ball may continue toward the center of main unit 502, and may enter the hole.

Figure 6B:
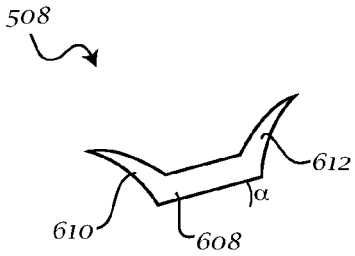

FIG. 6*b* may show an exemplary cross section of at least one rail 508 from FIG. 5*b*. At least one rail 508 may have a center portion 608, a left side 610, and a right side 612. As shown in FIG. 5*b*, at least one rail 508 may be curved between putting pad 504 and main unit 502, which may simulate a putt breaking from right to left. Further, as shown in FIG. 6*b*, at least one rail 508 may be at a bank angle $\alpha$, with respect to a ground surface, such that center portion 608 is angled and right side 612 may be raised with respect to left side 610. In this manner, at least one rail 508 may simulate a putt breaking from right to left.

For example, during use of the exemplary embodiment shown in FIGS. 5*b* and 6*b*, a golf ball may be struck from putting pad 504 with forward momentum toward at least one rail 508. The golf ball may enter rail 508. In the exemplary embodiment shown in FIG. 6*b*, if the ball is struck with too little forward momentum, after entering the at least one rail 508, the ball may move or fall laterally away from a centerline of the at least one rail 508 and toward the low side, or left side 610. The golf ball may exit the rail. Similarly, if the ball is struck with too much forward momentum, the ball may move or climb laterally away from a centerline of the at least one rail 508 and toward the high side, or right side 612. The golf ball may again exit the rail. However, if the golf ball is struck with an appropriate amount of forward momentum and within an acceptable range of offline tolerance simulated by the sides of the rail, the golf ball may travel the length of at least one rail 508, and may enter the main unit 502.

Thus, with reference to the clock analogy and FIG. 5*b*, the golf ball may exit the at least one rail 508 and may enter the main unit to the right of the hole at approximately 4:30 on the circumference of main unit 502. The golf ball may continue breaking from right to left, toward the center of main unit 502, and may enter the hole.

Figure 6C:
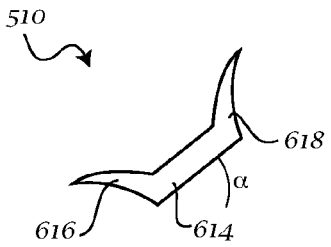

FIG. 6*c* may show an exemplary cross section of at least one rail 510 from FIG. 5*c*. At least one rail 510 may have a center portion 614, a left side 616 and a right side 618. As shown in FIG. 5*c*, at least one rail 510 may be curved between putting pad 504 and main unit 502, which may simulate a putt breaking from right to left. Further, as shown in FIG. 6*c*, least one rail 510 may be at a bank angle $\alpha$, with respect to a ground surface, such that center portion 614 is angled and right side 618 may be raised with respect to left side 616.

In comparison to the exemplary embodiment of at least one rail 508 shown in FIGS. 5*b* and 6*b*, at least one rail 510 may have a greater degree of curve than rail 508. Furthermore the bank angle $\alpha$ of at least one rail 510 may be greater than the bank angle $\alpha$ of at least one rail 508. Thus, at least one rail 510 may simulate a putt with a greater amount of break in the right to left direction than at least one rail 508.

For example, during use of the exemplary embodiment shown in FIGS. 5*c* and 6*c*, a golf ball may be struck from putting pad 504 with forward momentum toward at least one rail 510. The golf ball may enter rail 510. In the exemplary embodiment shown in FIG. 6*c*, if the ball is struck with too little forward momentum, after entering the at least one rail 510, the ball may move or fall laterally away from a centerline of the at least one rail 510 and toward the low side, or left side 616. The golf ball may exit the rail. Similarly, if the ball is struck with too much forward momentum, the ball may move or climb laterally away from a centerline of the at least one rail 508 and toward the high side, or right side 612. The golf ball may again exit the rail.

Due to the larger bank angle α, and curve of at least one rail 510, the initial forward momentum of the golf ball when entering the rail may need to be greater than when using, for example, rail 508 with a lower bank angle α, and curve. However, if the golf ball is struck with an appropriate amount of forward momentum and within an acceptable range of offline tolerance simulated by the sides of the rail, the golf ball may travel the length of at least one rail 510, and may enter the main unit 502.

Thus, with reference to the clock analogy and FIG. 5*c*, the golf ball may exit the at least one rail 510 and may enter the main unit to the right of the hole at approximately 3:00 on the circumference of main unit 502. The golf ball may continue breaking from right to left, toward the center of main unit 502, and may enter the hole.

Figure 6D:
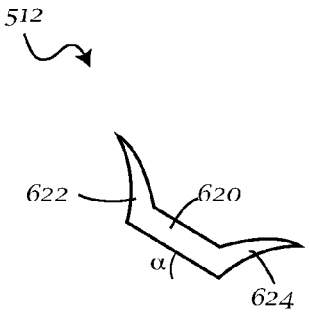

FIG. 6*d* may show an exemplary cross section of at least one rail 512 from FIG. 5*d*. At least one rail 512 may have a center portion 620, a left side 622 and a right side 624. As shown in FIG. 5*d*, at least one rail 512 may be curved between putting pad 104 and main unit 502, which may simulate a putt breaking from left to right. Further, as shown in FIG. 6*d*, least one rail 512 may be at a bank angle α, with respect to a ground surface, such that center portion 620 is angled and left side 622 may be raised with respect to right side 624. In this manner, at least one rail 512 may simulate a putt breaking from left to right.

For example, during use of the exemplary embodiment shown in FIGS. 5*d* and 6*d*, a golf ball may be struck from putting pad 504 with forward momentum toward at least one rail 512. The golf ball may enter rail 512. In the exemplary embodiment shown in FIG. 6*d*, if the ball is struck with too little forward momentum, after entering the at least one rail 512, the ball may move or fall laterally away from a centerline of the at least one rail 512 and toward the low side, or right side 624. The golf ball may then exit the rail. Similarly, if the ball is struck with too much forward momentum, the ball may move or climb laterally away from a centerline of the at least one rail 512 and toward the high side, or left side 612. The golf ball may again exit the rail. However, if the golf ball is struck with an appropriate amount of forward momentum and within an acceptable range of offline tolerance simulated by the sides of the rail, the golf ball may travel the length of at least one rail 512, and may enter the main unit 502.

Thus, with reference to the clock analogy and FIG. 5*d*, the golf ball may exit the at least one rail 512 and may enter the main unit to the left of the hole at approximately 7:30 on the circumference of main unit 502. The golf ball may continue breaking from left to right, toward the center of main unit 502, and may enter the hole.

Figure 6E:
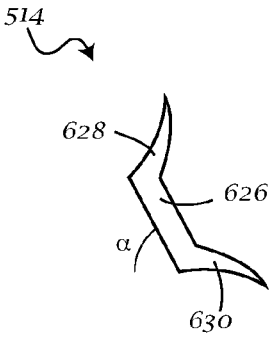

FIG. 6*e* may show an exemplary cross section of at least one rail 514 from FIG. 5*e*. At least one rail 514 may have a center portion 626, a left side 628 and a right side 630. As shown in FIG. 6*e*, at least one rail 514 may be a curved between putting pad 504 and main unit 502, which may simulate a putt breaking from left to right. Further, as shown in FIG. 6*e*, least one rail 514 may be at a bank angle α, with respect to a ground surface, such that center portion 626 is angled and left side 628 may be raised with respect to right side 630.

In comparison to the exemplary embodiment of at least one rail 512 shown in FIGS. 5*d* and 6*d*, at least one rail 514 may have a greater degree of curve than rail 512. Furthermore the bank angle α of at least one rail 514 may be greater than the bank angle α of at least one rail 512. Thus, at least one rail 514 may simulate a putt with a greater amount of break in the right to left direction than at least one rail 512.

For example, during use of the exemplary embodiment shown in FIGS. 5*e* and 6*e*, a golf ball may be struck from putting pad 104 with forward momentum toward at least one rail 514. The golf ball may enter rail 514. In the exemplary embodiment shown in FIG. 6*e*, if the ball is struck with too little forward momentum, after entering the at least one rail 514, the ball may move or fall laterally away from a centerline of the at least one rail 514 and toward the low side, or right side 630. The golf ball may then exit the rail. Similarly, if the ball is struck with too much forward momentum, the ball may move or climb laterally away from a centerline of the at least one rail 514 and toward the high side, or left side 628. The golf ball may again exit the rail.

Due to the larger bank angle α, and curve of at least one rail 514, the initial forward momentum of the golf ball when entering the rail may need to be greater than when using, for example, rail 512 with a lower bank angle α, and curve. However, if the golf ball is struck with an appropriate amount of forward momentum and within an acceptable range of offline tolerance simulated by the sides of the rail, the golf ball may travel the length of at least one rail 514, and may enter the main unit 502.

Thus, with reference to the clock analogy and FIG. 5*e*, the golf ball may exit the at least one rail 514 and may enter the main unit to the left side of the hole at approximately 9:00 on the circumference of main unit 502. The golf ball may continue breaking from left to right, toward the center of main unit 502, and may enter the hole.

With respect to the exemplary embodiments of FIGS. 5*a-g* and 6*a-e*, it should be understood that curvatures, cross sections, and banking angles of the rail may be adjusted or altered to simulate the "line" of any putt without deviating from the scope of the present invention. In some exemplary embodiments more than one rail may be used with a single putting pad and main unit. In other exemplary embodiments, a first rail may be removed, the main unit, putting pad or both may be rotated and a second rail with different variables may be inserted. In still further embodiments, a single flexible and rotatable rail may be used, and only the main unit, and/or putting pad may be rotated to simulate a different "line" using the same rail.

Referring generally to FIGS. 1-6, the exemplary use of the putting device 100 may be described as follows. A user may place a golf ball on ball placement spot 414 on putting pad 104. The user may address the putt, from either a right handed or left handed perspective, by placing the head of a putter behind the ball. The user may swing the putter back toward the stroke area 409 during the backswing, and then may proceed to strike the ball down putting line 410 in the direction of front end 402 and the at least one rail.

After impact, the user may utilize the different color of the putting line 410 as quick visual feedback as to the alignment of the putt. Fundamentally every putt should be stroked with straight angles in front of the body, to produce a straight putt. Thus, three of the more important fundamentals of a putt may be the path the putter head travels, the face angle of the putter head square and perpendicular to the intended path of the putt, and the centeredness of contact with the putter head sweet spot. For example, if the putter head travels in an incorrect path or does not squarely address the ball at impact, the ball may drift away from centerline 412 of putting line 410 in either the right or left direction and may not enter the rail. Alternatively, a ball hit off center on the putter head may enter the rail, but not have enough energy to carry the distance of the rail to the hole. Generally, these fundamentals are universal to any straight or breaking putt. Thus, the putting line 410 may therefore train the golfer to consistently hit a substantially straight putt, using good fundamentals, toward front end 402, regardless of the variables of the at least one rail.

As described in detail above, if a putt does enter the rail, it may still need to maintain momentum to the point where it may travel substantially along the centerline of the acceptable space defined by the variables of the rail being used, and enter the main unit. Further, in some instances, the ball may enter the main unit and still may not have the proper momentum to enter the hole, which may combat any cheating from a rail holding a poorly hit putt within the rail system.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A putting practice apparatus, comprising:

a main unit with a top surface and a bored hole through a center of the top surface and into a hollow portion of the main unit;

a putting pad with a front end and a rear end, the putting pad located at a distance to the main unit;

at least one straight rail between the main unit and putting pad, the at least one straight rail further comprising:

a first end coupled to an edge of the top surface;

a second end coupled to the front end of the putting pad;

a flat center portion;

a raised left side; and a raised right side, wherein the flat center portion, raised left side and raised right side extend a full length of the at least one straight rail between the first end and the second end, and the raised left side and the raised right side are substantially the same height;

wherein the at least one straight rail is removable, and at least one breaking rail is configured to couple between the main unit and the putting pad, the at least one breaking rail further comprising:

a first end coupled to an edge of the top surface;

a second end coupled to the front end of the putting pad;

a center portion, a first side, and a second side, extending a full length of the at least one breaking rail between the first end and the second end, wherein the breaking rail is banked at an angle with respect to the putting pad, such that the first side is higher than the second side, and the center portion slopes from the first side to the second side.

2. The putting practice apparatus of claim 1, wherein the at least one breaking rail is at least one of right breaking, or left breaking, between the first end and the second end.

3. The putting practice apparatus of claim 2, wherein the right breaking rail is banked at an angle with respect to the putting pad, such that the center portion slopes from a left side to a right side.

4. The putting practice apparatus of claim 2, wherein the left breaking rail is banked at an angle with respect to the putting pad, such that the center portion slopes down from a right side to a left side.

5. The putting apparatus of claim 1, wherein the main unit is rotatable about a vertical axis extending from the center of the bored hole.

6. The putting apparatus of claim 1, wherein the main unit further comprises a hole unit received within the bored hole; and an automatic ball return mechanism within the hole unit.

7. The putting practice apparatus of claim 1, wherein the top surface has a downward slope from a rear side toward a front side.

8. The putting practice apparatus of claim 1, further comprising a flag on the top surface of the main unit.

9. The putting apparatus of claim 1, wherein the top surface is circular, and the first end of the at least one straight rail and the first end of the at least one breaking rail can couple to any point on the circumference of the top surface.

10. The putting practice apparatus of claim 1, the putting pad further comprising:

a rear end;

a top surface;

a ball placement area on the top surface between the front end and the rear end;

a putting line on the top surface, the putting line having a centerline extending from the ball placement area to a midpoint on the front end; and a ball placement spot at an intersection of the centerline and the ball placement area.

11. The putting practice apparatus of claim 10, wherein the ball placement area and the putting line are a different color than the rest of the top surface.

12. The putting practice apparatus of claim 1, further comprising:

an undercarriage adapted to receive the putting pad;

a beginning rail system coupled to the undercarriage, the beginning rail system adapted to couple to the at least one straight rail and the at least one breaking rail.

13. The putting practice apparatus of claim 12, wherein the beginning rail system is universal to a rail of any shape or geometry.

* * * * *

UNITED STATES PATENT AND TRADEMARK OFFICE

CERTIFICATE OF CORRECTION

PATENT NO. : 9,089,758 B2
APPLICATION NO. : 13/952217
DATED : July 28, 2015
INVENTOR(S) : Matthew D. McWilliam It is certified that error appears in the above-identified patent and that said Letters Patent is hereby corrected as shown below:

On The Title Page,

Column 1, Item (71) Applicant: delete "McWilliams", and insert --McWilliam--.

Column 1, Item (72) Inventor: delete "McWilliams", and insert --McWilliam--.

Signed and Sealed this
First Day of March, 2016

Michelle K. Lee

Michelle K. Lee
*Director of the United States Patent and Trademark Office*